United States Patent [19]

Fletcher

[11] Patent Number: 4,901,071

[45] Date of Patent: Feb. 13, 1990

[54] PORTABLE RESERVED PARKING ALARM SYSTEM

[76] Inventor: Frank I. Fletcher, 915 E. Walnut Ave., Burbank, Calif. 91501

[21] Appl. No.: 331,606

[22] Filed: Mar. 30, 1989

[51] Int. Cl.[4] ..... G08G 1/00; E01F 13/00

[52] U.S. Cl. ..... 340/932.2; 49/49; 340/665; 361/170

[58] Field of Search ..... 340/932.2, 907, 908.1, 340/665, 648, 660–664, 571, 686, 825.72; 341/176; 361/170; 49/49; 194/900; 414/231–232

[56] References Cited

U.S. PATENT DOCUMENTS 4,232,484 11/1980 Buchmann ..... 49/49 X
4,284,983 8/1981 Lent ..... 340/571 X
4,713,910 12/1987 Quante ..... 49/49

*Primary Examiner*—Joseph A. Orsino
*Assistant Examiner*—Thomas J. Mullen, Jr.
*Attorney, Agent, or Firm*—John J. Hall

[57] ABSTRACT

A portable reserved parking alarm system including an electric motor contained in a housing mounted on a base plate and having a gear box mechanically connected to one end of an eccentric rod member whose other end is pivotally connected to a mast member, the lower end of said mast member being pivotally mounted on said base plate, said motor causing movement of said mast upon being energized by electrical means activated by a radio frequency signal, said electrical means including means for activating an alarm whenever said mast member is moved other than by action of said motor.

4 Claims, 3 Drawing Sheets

PORTABLE RESERVED PARKING ALARM SYSTEM

BACKGROUND OF THE INVENTION

1. Field of the Invention.

The present invention relates to a system of mechanical and electronic elements which are combined to produce a signal which will either permit authorized entry into a reserved parking space or sound an alarm for an unauthorized entry therein.

2. Description of the Prior Art.

Prior art devices that employ a locked barrier to prevent unauthorized entry to a reserved parking space are impracticable because a vehicle the size and weight of a conventional automobile or truck can easily overpower and overcome such a barrier.

Thus, anchored posts such as those disclosed in U.S. Pat. No. 4,713,910 (Quante) are of little practical use, Further, the Quante device can be activated by headlights of an unauthorized vehicle to gain entry into a reserved parking space, and is limited to light means of operation.

Other prior art devices are limited to mechanical types of locked barrier posts, such as those disclosed in U.S. Pat. Nos. 3,956,853 (Montgomery); 3,417,508 (Sprung); 4,050,190 (Mazzone); 3,688,439 (Doxsee); 3,925,929 (Montgomery); and 4,062,149 (Collins).

Further, all of the foregoing prior art lacks the capability of sounding an alarm in the event a driver of an unauthorized vehicle attempts to gain entry to a parking space reserved by the devices disclosed therein.

Moreover, a driver of an unauthorized vehicle may decide to gain entry to the reserved parking space even at the expense of knocking down the barrier post, resulting in damage and in operation of such devices, thereafter.

SUMMARY OF THE INVENTION

The present invention provides a device which has two modes of operation, normal and abnormal. The invention for the most part uses conventional component parts which are arranged in a novel combination and produce a novel and inventive result.

The invention has a base plate which supports a housing containing a permanent magnet type electric motor with a gear box of conventional structure, mounted on an L-shaped bracket.

The output shaft of the gear box is pivotally connected to an output arm with an outer end pivotally connected to an eccentric connecting rod whose other end is pivotally connected to a support bracket for a sign support mast.

The travel of the gear box output arm is limited between two limit stop screws each inserted into holes in a flange formed at each side of the L-shaped bracket, one screw being a down limit stop and the other an up limit stop.

The bottom portion of the sign support bracket is pivotally mounted on a pivot block which is secured to the base plate.

The housing also contains a radio frequency (rf) radio receiver with an antenna which responds to a coded rf signal from a portable radio transmitter which can be located in a vehicle or in an office.

A source of electricity is provided by batteries contained inside the housing which supply current for the electric motor, radio receiver, and a novel circuit for control of the motor and for raising an alarm for an unauthorized entry into the reserved parking space.

The circuit controlling the motor and alarm includes a bistable multivibrator which receives the output from the rf radio receiver when a coded rf signal is received from the rf radio transmitter. The bistable multivibrator is then activated and creates a current flowing into a bistable circuit element, thereby changing its state and causing current to go through an AND gate to energize a relay coil and relay contact in the motor circuit.

The motor circuit, before the relay coil and relay contact are energized, has no current flowing through it because it is connected through the relay contacts which are not positioned to place voltage on the contacts. As soon as the relay coil and relay contact are energized, the positive bias of one diode becomes negative, and current then flows through the motor circuit and the motor, thereby causing rotation of the output arm which results in lowering of the mast from an upright position to a horizontal position.

The output arm approaches and hits the down limit stop, which prevents further travel of the output arm, thereby increasing the motor current because the motor rotor does not turn while current is passing through the motor. This increase in current is sensed by a motor current sensor through a nichrome wire resistor which determines a preset level of current and voltage to be monitored by the motor current sensor. As soon as that preset level is exceeded, the motor current sensor sends a signal voltage to the bistable multivibrator, changing its state and causing it to send a signal to the bistable circuit element.

The bistable circuit element then sends a signal to a second AND gate which produces an output that energizes a second relay coil and relay contact, causing a change in position of the second relay contact so that the positive polarity at both diodes of the motor circuit is restored and thus stopping current flow and the motor.

In its stopped condition, the parking system is in a reverse position so that when the next rf input is sent into the bistable multivibrator, the entire process is reversed until the output arm hits the up limit stop, which increases motor current as before and causes the motor to stop. At this point, the system remains in the reverse condition from what it was at the beginning of the rising of the mast and output arm.

The alarm of the system is activated at any time that the mast is forced down or up by any means other than the motor. The motor is equipped with a speed reducer which changes the input to output ratio to about 300 to 1. Thus, it takes 300 motor turns to turn the motor output shaft one time.

Thus, a slight pressure on the mast will be transferred back to the motor causing it to act as a generator. The voltage output from the motor goes into a generator voltage sensor and its output goes into a monostable multivibrator. The voltage output from the monostable multivibrator has a predetermined time limit and leads to and activates an alarm device, which may be audio or visible light or both. The alarm circuit has an oscillator to drive the alarm device when it is activated by the monostable multivibrator.

After the alarm has been activated, the monostable multivibrator sends a signal to bistable circuit device, which operates as before to raise or lower the mast in accordance with the mode of operation for an authorized entry.

However, if the initial movement of the mast were caused by an unauthorized entry by manual force or by a vehicle, i.e. an abnormal operation, after the alarm has been sounded, the system will operate to either lower the mast or raise it.

If the mast is lowered, it will continue until stopped by the down limit stop and remain in that position. If the mast is rising, as soon as it hits the vehicle over it, it will be stopped in the same manner as a normal mode of operation, the motor will be stopped, and reversed so that the mast will return to a horizontal position without damage to the vehicle or to the parking system.

OBJECTS OF THE INVENTION

It is, therefore, an object of this invention to provide a portable reserved parking alarm system which dispenses with locked barrier post devices and uses an rf signal for activating its operation from a remote location.

Another object of this invention is to provide a portable reserved parking alarm system which produces an alarm in the event of an unauthorized entry.

A further object of this invention is to provide a portable reserved parking alarm system which will not be damaged or broken or rendered inoperative by an unauthorized entry or forcing of the system. A yet further object of this invention is to provide a portable reserved parking alarm system which will instantly detect an obstruction to its mast means and act automatically to clear the obstruction and turn off the system.

These and other objects will be more readily understood by reference to the following description and accompanying drawings, in which FIG. 1 is an overall perspective showing the installation of an embodiment of the invention in two modes, upright and horizontal.

Figure 1:
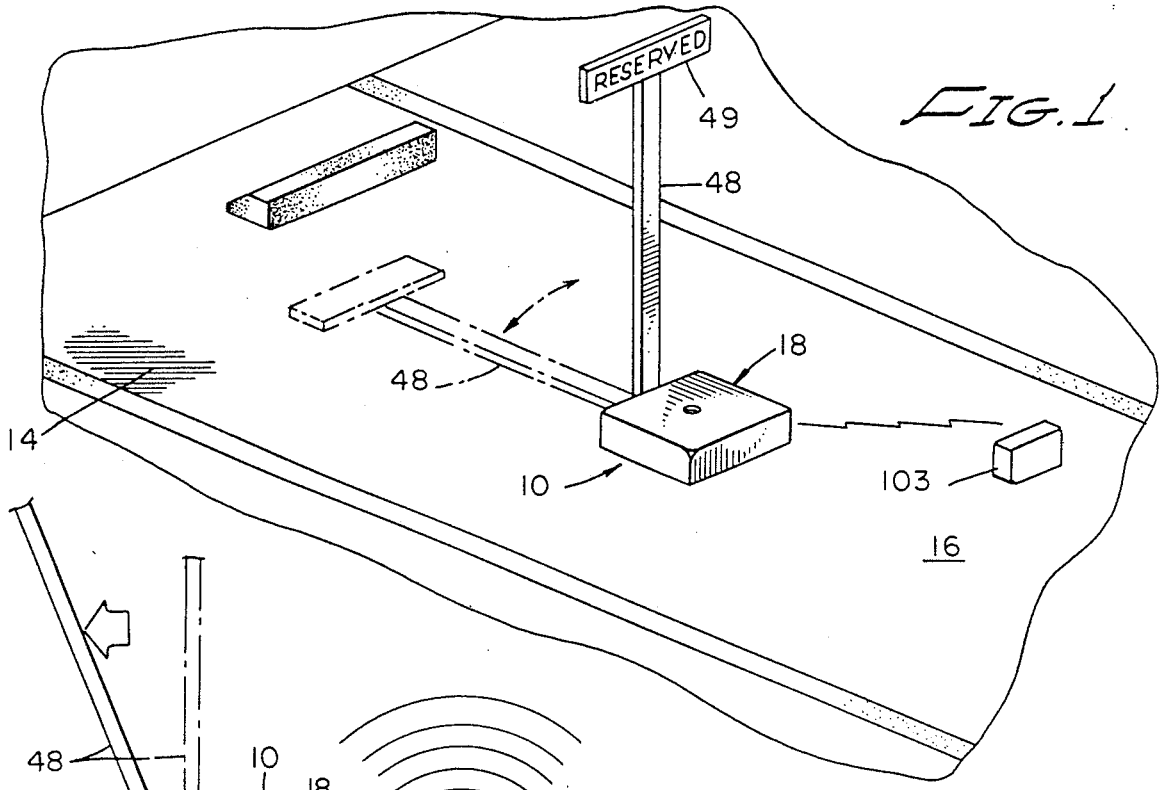
Figure 2:
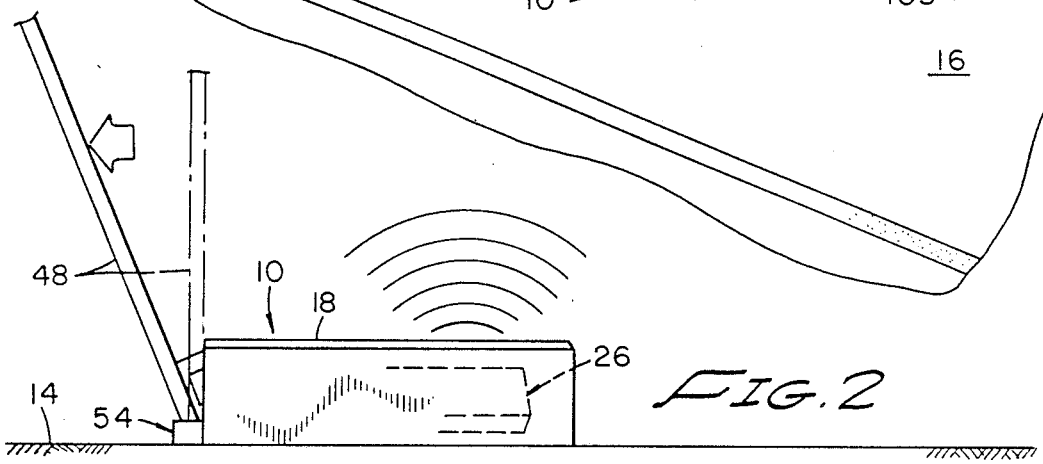
FIG. 2 is a side elevational view illustrating an alarm activated by unauthorized entry into the parking space reserved by the invention.

The portable reserved parking alarm system 10 has a base plate 12 which is placed on the ground 14 of a parking space 16 to be reserved. Base plate 12 may be affixed to the ground 14 by any suitable means such as gluing and the like, or may only be placed in position without being affixed to the ground 14.

Base plate 12 supports a housing 18 which contains a conventional permanent magnet type electric motor 20 with a gear box 22 of conventional construction. The motor 20 is equipped with a speed reducer having a ratio of about 300:1 and having an output shaft 24.

Housing 18 also contains a conventional radio frequency (rf) radio receiver 26 with an antenna 27 of a compact size which responds to a coded rf signal from a conventional remote radio transmitter 103.

Motor 20 is mounted on an L-shaped bracket 28 secured to the top surface of base plate 12. Motor output shaft 24 is connected at its outer end 30 to the bottom end 32 of gear box output arm 34 by any suitable mechanical means (not shown). The top end 36 of gear box output arm 34 is pivotally connected to the inner end 38 of eccentric connecting rod 40.

The outer end 42 of eccentric connecting rod 40 is pivotally connected to the top end 44 of sign support bracket 46. Mast 48 supports sign 49 and is rigidly mounted by any suitable means such as screw 50 and the like to the middle portion of sign support bracket 46.

The bottom end 52 of sign support bracket 46 is pivotally on pivot block 54, which is secured to the top surface of base plate 12 by any suitable means such as screws 56 or the like.

The extent of travel of gear box output arm 34 is controlled by up limit stop screw 58 and down limit stop screw 60, each threaded into an opening 62 in flange 64 formed from the side of L-shaped bracket 28.

Housing 18 is secured to base plate 12 by any suitable means such as a bolt 66 threaded into a threaded member 68 mounted by welding or other suitable means to the top surface of base plate 12.

The portable reserved parking alarm system 10 includes an electrical circuit system 70 which controls its operation.

System 70 has a bistable multivibrator 72 which is connected to a bistable circuit element 74 whose output leads to a pair of AND gates, top AND gate 76 and bottom AND gate 78. The output of AND gate 76 leads to top relay coil 80 and to top relay contact 82. The output of AND gate 78 leads to bottom relay coil 84 and to bottom relay contact 86.

The system 70 includes top diode 88 and bottom diode 90 and motor current sensor 92. The input to motor current sensor 92 goes through a nichrome wire resistor 94. The output of motor current sensor 92 leads to the bistable multivibrator 72.

The system 70 is provided with a generator voltage sensor 95 whose output goes to an alarm system 96 made up of a monostable multivibrator 98 with its output leading to alarm member 100 and to oscillator 102 which drives the alarm member 100. The monostable multivibrator 98 is also connected to bistable circuit element 74.

All of the electrical components are conventional in their structure and design, and are commercially available.

In normal operation, the portable reserved parking alarm system 10 is in a pre-set condition with mast 48 in an upright or vertical position, reserving an assigned parking space 16, and is provided with a source of electric power, such as batteries 104.

When a person having an assigned parking space wishes to park his vehicle there, he activates a portable rf radio transmitter which he carries with him or in his vehicle.

The rf transmitter 103 then sends a coded rf signal which is received by antenna 27 and transmitted to the rf receiver 26.

The output from the rf receiver 26 is fed into the input of bistable multivibrator 72, which is then activated to create an electric current that is conducted into bistable circuit element 74.

Bistable circuit element 74 is initially in its last state which it remembers before being activated by the current flow from bistable multivibrator 72. The current flow from bistable multivibrator 72 causes bistable circuit element 74 to change its preexisting state to another state. At this time, top AND gate 76 is in an open state and bottom AND gate 78 is in a closed state.

The change in state of bistable circuit element 74 causes current to flow through bottom AND gate 78 through bottom relay coil 84 to bottom relay contact 86. At this time, the pre-existing condition of the relay contacts 82 and 86 remains the same, thereby preventing current flow through motor 20, which remains stopped.

However, the current flowing through bottom relay coil 84 causes the relay contact 86 to change the polarity at the motor 20 through the diode 88 and through the diode 90 from positive to negative, and thereby causes current to flow through motor 20, which in turn causes output shaft 24 to turn counterclockwise and lower gear box output arm 34.

The lowering of output arm 34 causes lowering of mast 48 through the action of eccentric connecting rod 40.

The lowering travel of output arm 34 continues until it reaches and hits down limit stop screw 60, which prevents further travel of output arm 34. The stopping of further travel of output arm 34 causes an increase in motor current because the rotor of motor 20 is prevented from turning while current is passing through motor 20. This increase is instantly recognized by motor current sensor 92 through increased current flow and a voltage drop across nichrome wire resistor 94.

The length of resistor 94, i.e., the amount of its resistance, determines a preset level of current and voltage drop which is being monitored by motor current sensor 92. When that level is exceeded, motor current sensor 92 sends a signal voltage to bistable multivibrator 72, which changes it to its other state, which, in turn, sends a signal to bistable circuit element 74, which passes it on to top AND gate 76.

The output of top AND gate 76 goes through top relay coil 80, which then changes its position so that the positive polarity at bottom diode 90 is restored from negative, thereby stopping further flow of current through motor 20, resulting in the stopping of the motor.

The system 10 in its stopped position now is in a reverse condition so that when the next rf input is sent into bistable multivibrator 72, the entire process is reversed so that mast 48 comes back up towards its original upright position until output arm 34 hits up limit stop screw 58, which stops further travel upward of output arm 34.

The resulting increase in motor current then operates in the same way as before, turning off motor 20, and leaving the system 10 in the reverse condition from that in which it began.

Several kinds of abnormal operation may occur. The mast 48 may be forced up or down manually. The mechanical construction of the portable reserved parking alarm system 10 is such that the mast 48 will not resist such forced movement mechanically but will yield and can be either pushed down towards a horizontal position from its upright position or vice versa, without damage to any of its component parts.

In either case, the system 10 will cause an alarm to be sounded for a predetermined length of time. The alarm is activated any time that the mast 34 is forced down or up by any means except by the action of motor 20.

The motor 20 is a permanent magnet type motor with a speed reducer which changes the input to output ratio to about 300 to 1. Thus, it takes 300 motor turns to turn the output shaft 24 one time.

Figure 3:
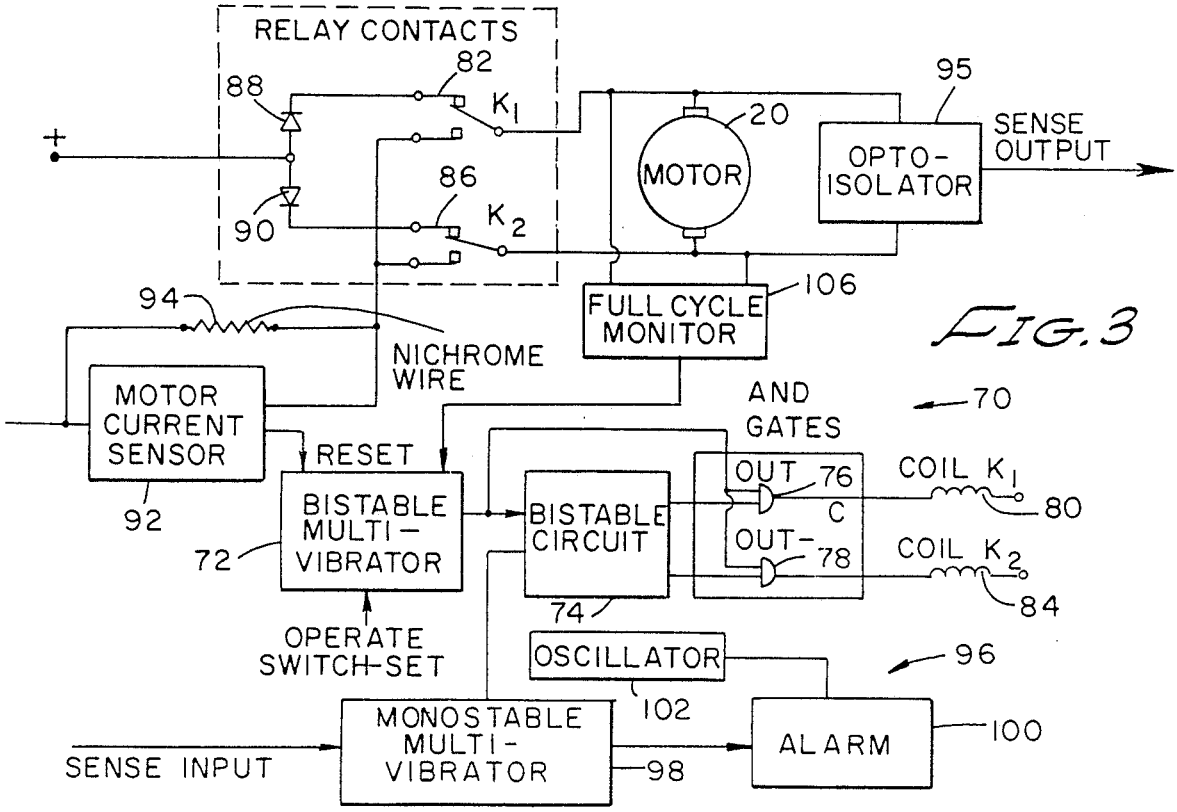
FIG. 3 is a schematic diagram of the electrical components of the motor control system of an embodiment of the invention.
Figure 4:
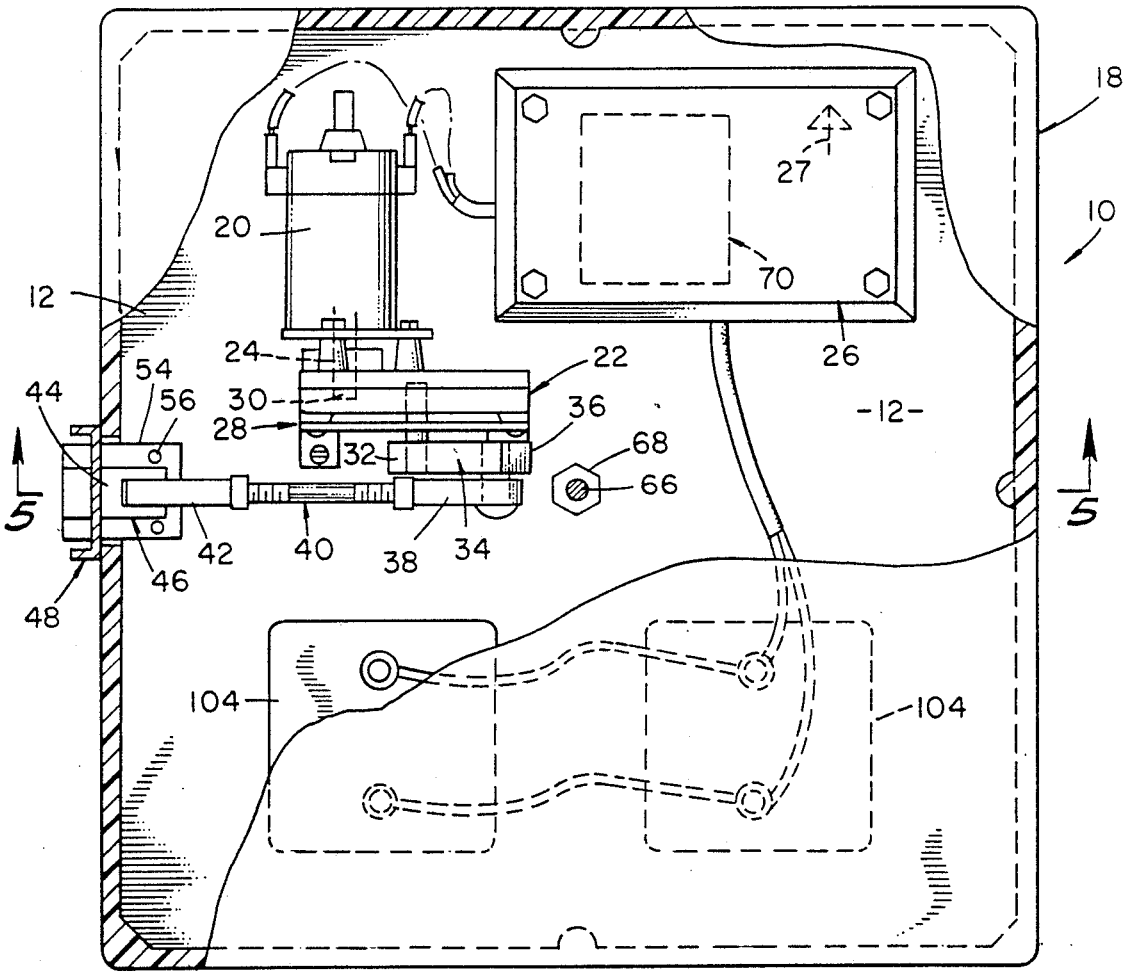
FIG. 4 is a top plan elevational view with elements of an embodiment of the invention broken away to illustrate the various mechanical components of the invention, including the location of batteries.
Figure 7:
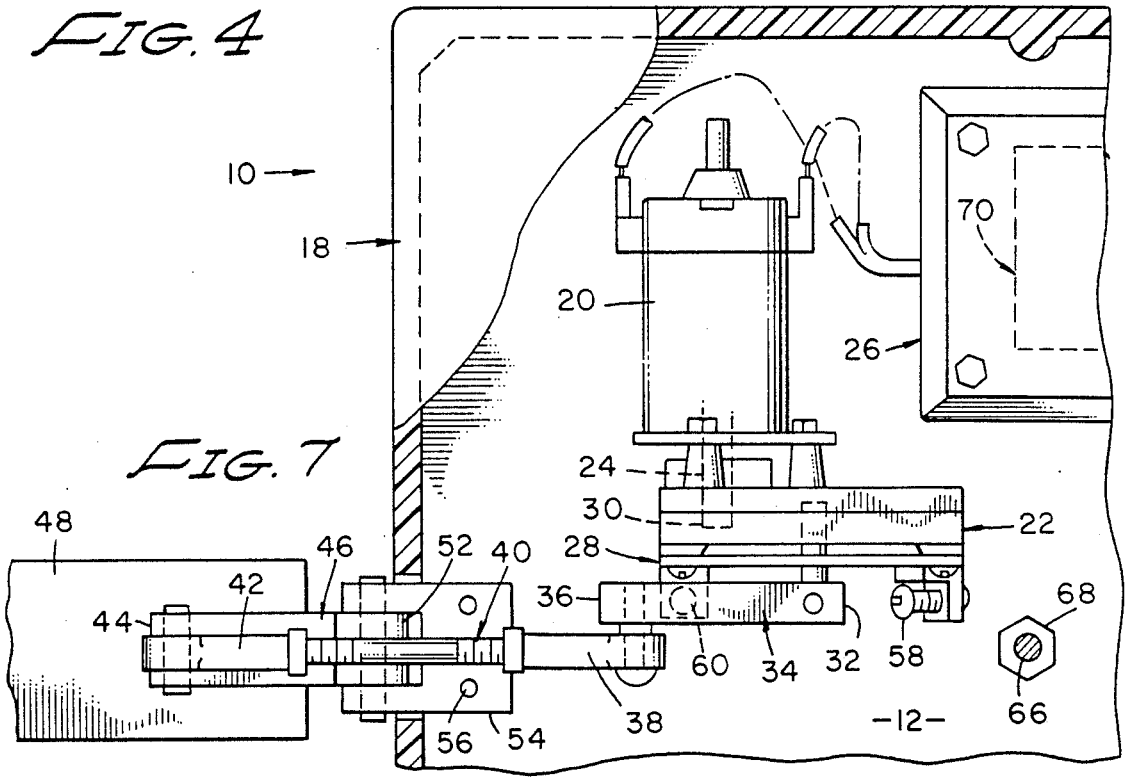
FIG. 7 is a top plan elevational view taken on line 7—7 of FIG. 6.
Figure 5:
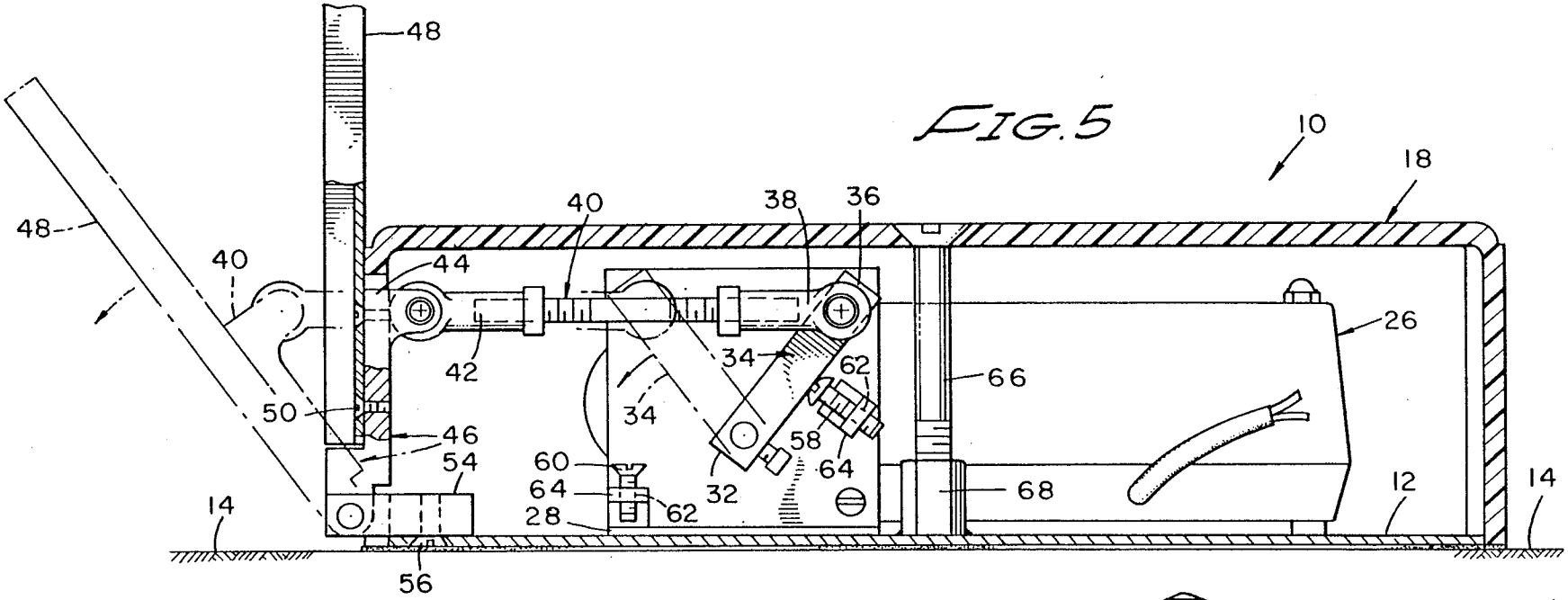
FIG. 5 is a side elevational cross sectional view taken on line 5—5 of FIG. 4.
Figure 8:
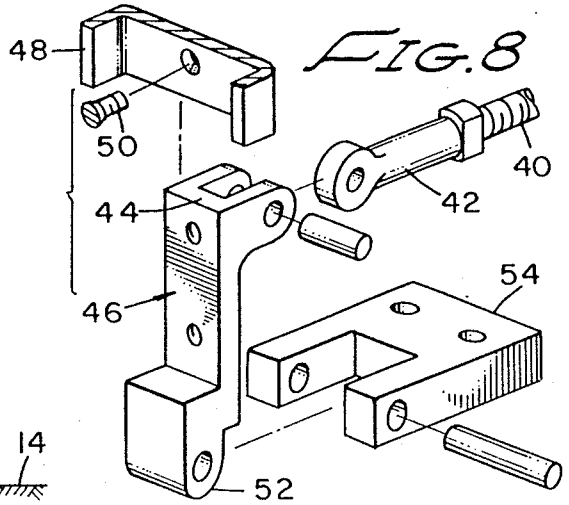
FIG. 8 is an exploded perspective view of component parts of an embodiment of the invention illustrating the mechanical means for movement of the mast element of the invention.
Figure 6:
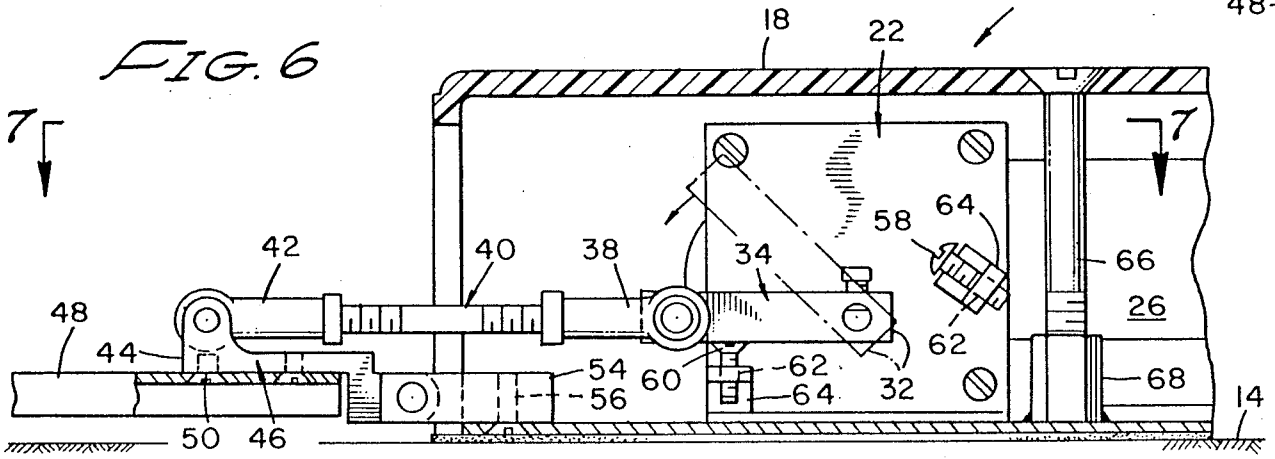
FIG. 6 is a side elevational cross sectional view similar to FIG. 5 illustrating the lowering operation of an embodiment of the invention.

Accordingly, a slight pressure on the mast 48 will be transferred back to motor 20 at a 1 to 300 ratio and the rotor of the motor 20 will spin rapidly, thereby acting as a generator and producing an electric current and voltage output, which is received by generator voltage sensor 95, the opto-isolator of FIG. 3.

The voltage output from the generator voltage sensor 95 is then fed into alarm system 96 and goes into monostable multivibrator 98 and to the alarm 100.

A conventional full cycle monitor 106 equipped with an internal timer monitors the cycle time required for the travel of the mast 48 from horizontal to vertical and vice versa. Monitor 106 is powered by the same source of electric power as the rest of system 10, such as batteries 104, and is connected in parallel with the motor 20.

Monitor 106 receives the same current and voltage as motor 20 and has the same polarity applied to it as motor 20. The timer of monitor 106 checks the time duration of the application of electric power to motor 20 for the completion of a full cycle of travel of mast 48, which is normally 90°.

If travel of mast 48 is interrupted so it does not complete a full cycle, the current and voltage applied to motor 20 is also interrupted as previously described, operation of the motor 20 is stopped, all of which is sensed by the internal timer of monitor 106, which then causes the production of an output voltage from monitor 106 which leads to and energizes bistable multivibrator 72, thereby resulting in mast 48 returning to its horizontal position as explained above.

Thus, if mast 48 travels up under a parked vehicle and strikes the bottom of the vehicle, thereby causing restriction of its travel and preventing the occurrence of a full cycle, i.e.,producing a short cycle of less than 90°, the full cycle monitor becomes operative and energizes the bistable multivibrator 72 which causes a change in polarity at the motor 20 as previously described, thereby causing the mast 48 to be lowered and returned to a horizontal position.

Although I have described the invention in detail with reference to the accompanying drawings illustrating preferred embodiments of the invention, it is understood that numerous changes may be made in the details of construction and arrangement of parts without departing from the spirit and scope of the invention as hereinafter claimed.

I claim:

1. A portable reserved parking alarm system comprising:

a housing removably mounted on a base plate, an electric motor mounted on a bracket secured to said base plate and located within said housing, said motor having a 300:1 speed reducer member, a gear box connected to said motor and having an output shaft with an outer end, an output arm with a top end and a bottom end that is connected to said outer end of said output shaft of said gear box a pivot block member mounted at one end of said base plate, a sign support bracket having a bottom end pivotally mounted on said pivot block and having a top end, a sign support mast member mounted on said sign support bracket and having a top end provided with a sign member, an eccentric rod having an inner end pivotally connected to said top end of said output arm and having an outer end pivotally connected to said top end of said sign support bracket, means mounted on said bracket for limiting up and down travel of said output arm, means located within said housing for energizing said motor upon activation by a radio frequency signal from outside of said housing, and means for activating an alarm whenever said sign support mast member is moved other than by the action of said motor.

2. A portable reserved parking alarm system according to claim 1 in which said means for activating an alarm comprises:

a generator voltage sensor that receives current and voltage output generated by said motor whenever said sign support mast member is moved by pressure from outside said system, said sensor in turn producing a voltage output;

a monostable multivibrator member that receives the voltage output from said generator voltage sensor, said multivibrator member producing in turn a voltage output leading to and activating an oscillator member; and an alarm member driven by said oscillator.

3. A portable reserved parking alarm system according to claim 1 in which said means located within said housing for energizing said motor when activated by a radio frequency signal from outside of said housing comprises:

a radio frequency receiver located within said housing and provided with an antenna responsive to a coded radio frequency signal from a remote frequency transmitter;

a source of electric power to activate said system upon receipt of a signal by said receiver;

a bistable multivibrator producing a voltage output when activated by said signal;

a bistable circuit element receiving said voltage output of said bistable multivibrator and producing a voltage output leading alternatively to a top AND gate controlling a top relay coil and a top relay contact in one polarity mode, and to a bottom AND gate controlling a bottom relay coil and a bottom relay contact in the opposite polarity mode, said top and bottom relay contacts connected to said motor and each of said contacts having a diode controlling polarity at said motor and controlling current flow through said motor depending upon which of said relay contacts is energized; and a motor current sensor for receiving current input through a resistor element when said current input is produced by said motor, and having an output leading to said bistable multivibrator.

4. In a portable reserved parking system which includes electrical motor and circuit means powered by a source of electric power for causing mechanical means to raise and lower a mast member, the improvement of monitor means for causing the lowering of said mast member whenever the upward travel of said mast member is restricted by something outside said system, comprising:

a full cycle monitor member connected in parallel to the said electrical motor and circuit means, said monitor member having an internal timer which causes an output voltage to be produced from said monitor whenever said electrical motor is stopped due to restriction of upward travel of said mast member, said output voltage leading to and energizing a bistable multi-vibrator member to produce an output voltage leading to a bistable circuit member, which in turn produces an output voltage leading alternatively to a top AND gate controlling a top relay coil and a top relay contact in one polarity mode, and to a bottom AND gate controlling a bottom relay coil and a bottom relay contact in the opposite polarity mode, said top and bottom relay contacts connected to said electrical motor and each of said contacts provided with a diode controlling polarity of said motor and controlling current flow through said motor depending upon which of said relay contacts is energized.

* * * * *